US006089840A

United States Patent [19]

Iizuka et al.

[11] Patent Number: 6,089,840

[45] Date of Patent: Jul. 18, 2000

[54] SCROLL COMPRESSOR IN WHICH AN ECCENTRIC BUSH IS RADIALLY MOVABLE WITH BEING GUIDED BY A GUIDE PIN

[75] Inventors: Jiro Iizuka, Takasaki; Akiyoshi Higashiyama, Gunma, both of Japan

[73] Assignee: Sanden Corporation, Gunma, Japan

[21] Appl. No.: 09/203,603

[22] Filed: Dec. 2, 1998

[30] Foreign Application Priority Data

Dec. 3, 1997 [JP] Japan ..... 9-347304

[51] Int. Cl.[7] ..... F01C 1/02

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 1,906,141 | 4/1933 | Ekelöf . | |
| 1,906,142 | 4/1933 | Ekelöf . | |
| 2,439,479 | 4/1948 | Mackmann . | |
| 3,113,527 | 12/1963 | Kramer . | |
| 4,580,956 | 4/1986 | Takahashi et al. . | |
| 4,808,094 | 2/1989 | Sugimoto et al. | 418/57 |
| 5,362,218 | 11/1994 | Fukanuma et al. | 418/55.5 |
| 5,366,635 | 11/1994 | Fukanuma et al. | 418/55.5 |

FOREIGN PATENT DOCUMENTS

| | | | |
|---|---|---|---|
| 4-87382 | 7/1992 | Japan . | |
| 405149271 | 6/1993 | Japan | 418/55.5 |
| 406185477 | 7/1994 | Japan | 418/55.5 |
| 406257575 | 9/1994 | Japan | 418/55.5 |

*Primary Examiner*—Thomas Denion
*Assistant Examiner*—Theresa Trieu
*Attorney, Agent, or Firm*—Baker Botts L.L.P.

[57] ABSTRACT

In a scroll compressor in which a movable scroll member (4) is eccentrically spaced from a fixed scroll member (5) and rotatably holds an eccentric bush (3) having a bush hole (30) inserted with a crank pin (110) of a crank shaft (10), the eccentric bush is movable in a radial direction of the crank pin and is guided by a guide pin (11) fixed to the eccentric bush. A pin hole (1110) is formed to penetrate the crank pin in the radial direction. The guide pin extends through the pin hole in the radial direction. Movement of the eccentric bush is guided with the guide pin being cooperated with the pin hole.

15 Claims, 6 Drawing Sheets

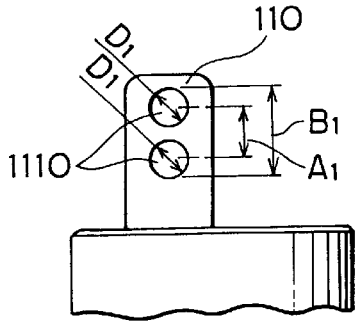
FIG. 9A
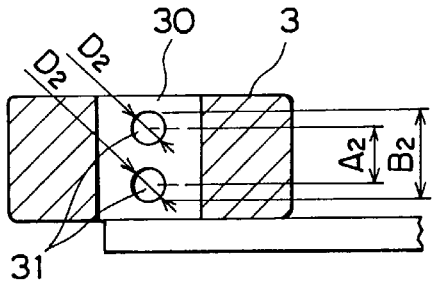
FIG. 9B
FIG. 9C
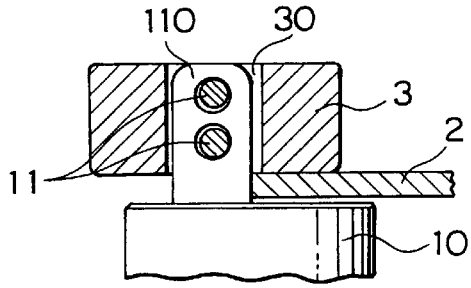
FIG. 9D
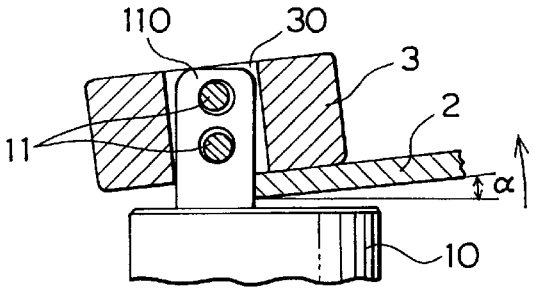
FIG. 9E
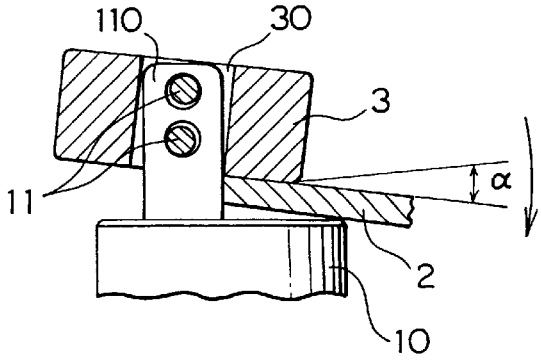

SCROLL COMPRESSOR IN WHICH AN ECCENTRIC BUSH IS RADIALLY MOVABLE WITH BEING GUIDED BY A GUIDE PIN

BACKGROUND OF THE INVENTION

The present invention relates in general to a scroll type compressor (hereinafter referred to as "scroll compressor" for clarification and simplification only) and more particularly to a driving mechanism comprising primarily a crank shaft and an eccentric bushing wherein the scroll driving mechanism is responding to variance of radius of orbiting motion of movable scroll part or member in the scroll compressor. Further, the present invention relates to a compression mechanism including a vacuum pump and an expansion device which employs the similar mechanism as the scroll compressor employing a movable scroll member.

A scroll compressor including a movable scroll member which has a variable orbit radius, whose detailed structure and operation will be described presently, generally has a unitary structure of a counter weight and an eccentric bush is supported by a crank pin fixed to a large-diameter portion of a main axis of the crank shaft in such a manner that the center of gravity is spaced or shifted from the fulcrum (supporting point). When an orbiting speed is increased, the counter weight is inclined, by its centrifugal force, toward the main axis of the crank shaft.

The inclination of the counter weight as described above will possibly provide an unexpected contact with peripheral parts and elements, with the result of damages in the peripheral parts and elements in the worst case.

An attempt was made to solve the problems and disadvantages described above in the scroll compressor employing a slide type variable orbiting radius mechanism as disclosed in Japanese Utility Model Publication (Unexamined) 4-87382 (1992). For the purpose of clarification and simplification, the disclosure of the Japanese U.M. Publication will now be explained.

Referring to FIGS. 1 and 2, a movable scroll member rotatably holds an eccentric bush 3 through a radial needle bearing 22. The eccentric bush 3 is unitarily formed with a counter weight 2 and snugly adapted to a crank pin 110. The eccentric bush 3 has a bush hole 30 into which the crank pin 110 is fitted. The crank pin 110 is eccentrically connected to the large diameter portion 10 of a main shaft or a crank shaft 1. A groove or a hole is formed to extend in a radial direction of the crank pin 110. The groove has a size which is larger than that of the crank pin 110. So that, the eccentric bush 3 can slide therealong in the radial direction of the crank pin 110. In other words, the groove permits to vary the orbiting radius. If the crank pin 110 is closely fitted in the bush hole 30, it is not likely that the counter weight 2 is inclined by a centrifugal force added to the counter weight. However, there is a gap or a "play" of the groove and, accordingly, the counter weight is inclined when a centrifugal force is added by the reasons set forth below.

In the scroll compressor of the structure as described above, the eccentric bush 3 is supported by a single crank pin. In addition, the counter weight 2 is fitted to the eccentric bush 3. Thus, the center of gravity of the unitary structure of the counter weight 2 and the eccentric bush 3 is eccentrically located or offset towards the counter weight 2.

In general, balancing is made by the use of the crank pin 110. When a centrifugal force is added, the balanced condition is broken, with the result of inclination of the counter weight 2. This is the reason why the counter weight is inclined. This inclination is controlled by an inclination controller 24. A bolt may be used for the inclination controller 24.

The conventional scroll compressor of a variable orbit-radius type has a serious problem of inclination of the counter weight as described above and this problem of the counter weight inclination possibly results in damages of the peripheral parts and elements due to the unexpected contact of the counter weight against the peripheral parts and elements.

In addition to the above, a slide groove of a substantially oblong shape serves to permit the variable orbit radius and, therefore, the shapes of the crank pin of the large diameter portion of the main axis and the hole of the crank pin of the eccentric bush are special and unusual and, therefore, requires substantial working costs.

The problem of counter weight inclination is supposed to be satisfactorily solved by the attempt of using a inclination restriction bolt as disclosed in aforementioned Japanese Utility Model Publication (Unexamined) 4-87382. However, the formation of the slide groove needs a special working and technique, resulting in an increase of production costs and this cost problem has not yet been solved.

Further, additional mechanism of applying the inclination restriction bolt must be provided which results in a further increase of working and production costs.

SUMMARY OF THE INVENTION

It is therefore an object of the present invention to provide an improved scroll compressor in which a problem is solved about inclination of a counter weight.

It is another object of the present invention to provide a scroll compressor of the type described, in which a problem is solved about manufacture of an eccentric bush is still another object of the present invention to provide a scroll compressor of the type described, in which improvement is carried out as regards a crank pin and an eccentric bush.

It is yet another object of the present invention to provide a scroll compressor of the type described, in which the eccentric bush is radially movable with being guided by a guide pin which penetrates the crank pin and fixed to the eccentric bush.

Other objects of the present invention will become clear as the description proceeds.

A scroll compressor to which the present invention is applicable comprises a fixed scroll member, a movable scroll member eccentrically spaced from the fixed scroll member, an eccentric bush rotatably held to said movable scroll member and having a bush hole therein, and a crank shaft having a crank pin inserted in said bush hole.

According to a first aspect of the present invention, the bush hole has a size which permits the eccentric bush to move in a radial direction of the crank pin. The crank pin has a pin hole extending to penetrate the crank pin in the radial direction. The scroll compressor further comprises a guide pin fixed to the eccentric bush and extending through the pin hole in the radial direction to guide movement of the eccentric bush in the radial direction.

According to a second aspect of the present invention, the bush hole has a size which permits the eccentric bush to move in a radial direction of the crank pin. The crank pin having a plurality of pin holes each extending to penetrate the crank pin in said radial direction. The scroll compressor further comprises a plurality of guide pins fixed to the eccentric bush and extending parallel to each other through the pin holes in the radial direction, respectively, to guide movement of the eccentric bush in the redial direction.

BRIEF DESCRIPTION OF THE DRAWING

FIGS. 9A to 9E are explanatory views showing the size and distance of a crank shaft pin and a pin hole of an eccentric bush according to the scroll compressor of two-guide pin structure and inclination of a counter weight in the structure.

DESCRIPTION OF THE PREFERRED EMBODIMENT

Figure 1:
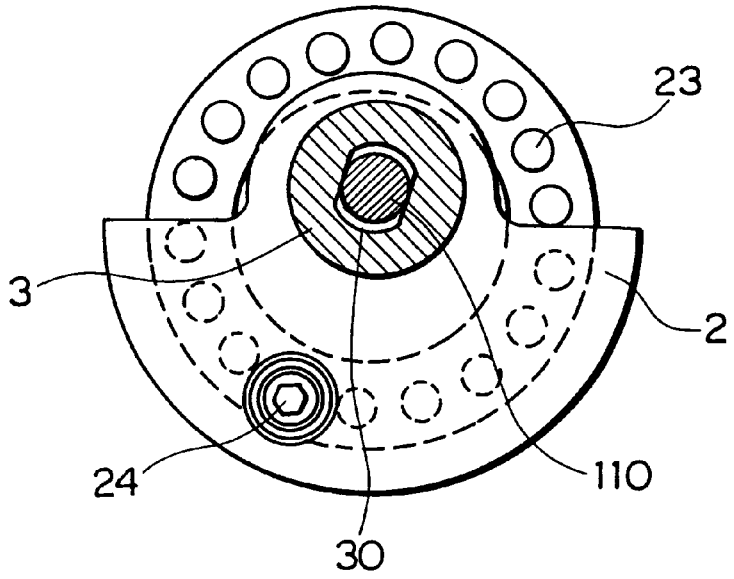
FIG. 1 PRIOR ART
FIGS. 1 and 2 are diagrams, for the purpose of explanation of prior art and general structure, of an example of prior art shown in Japanese Utility Model Publication (Unexamined) 4-87382, showing a counter weight inclination prevention mechanism and a scroll compressor.
Figure 2:
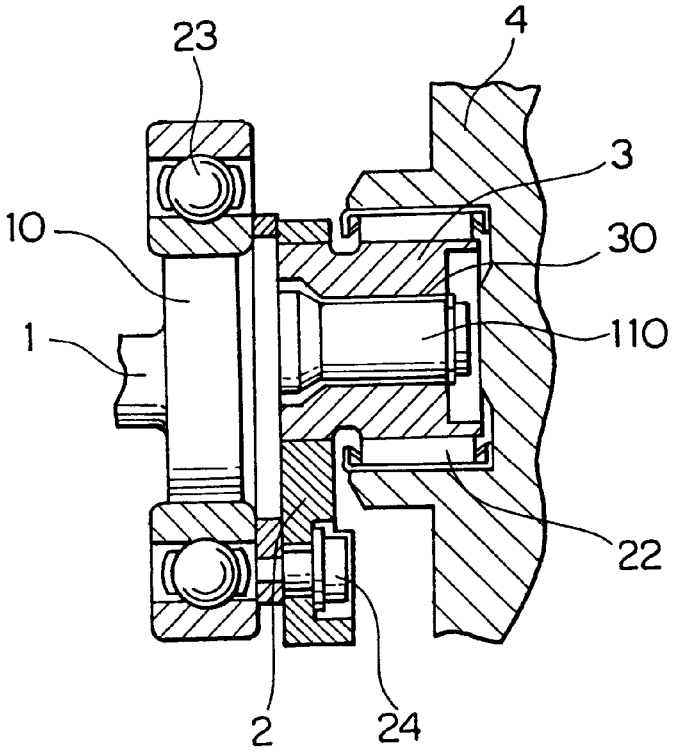
FIG. 2 PRIOR ART
Figure 3:
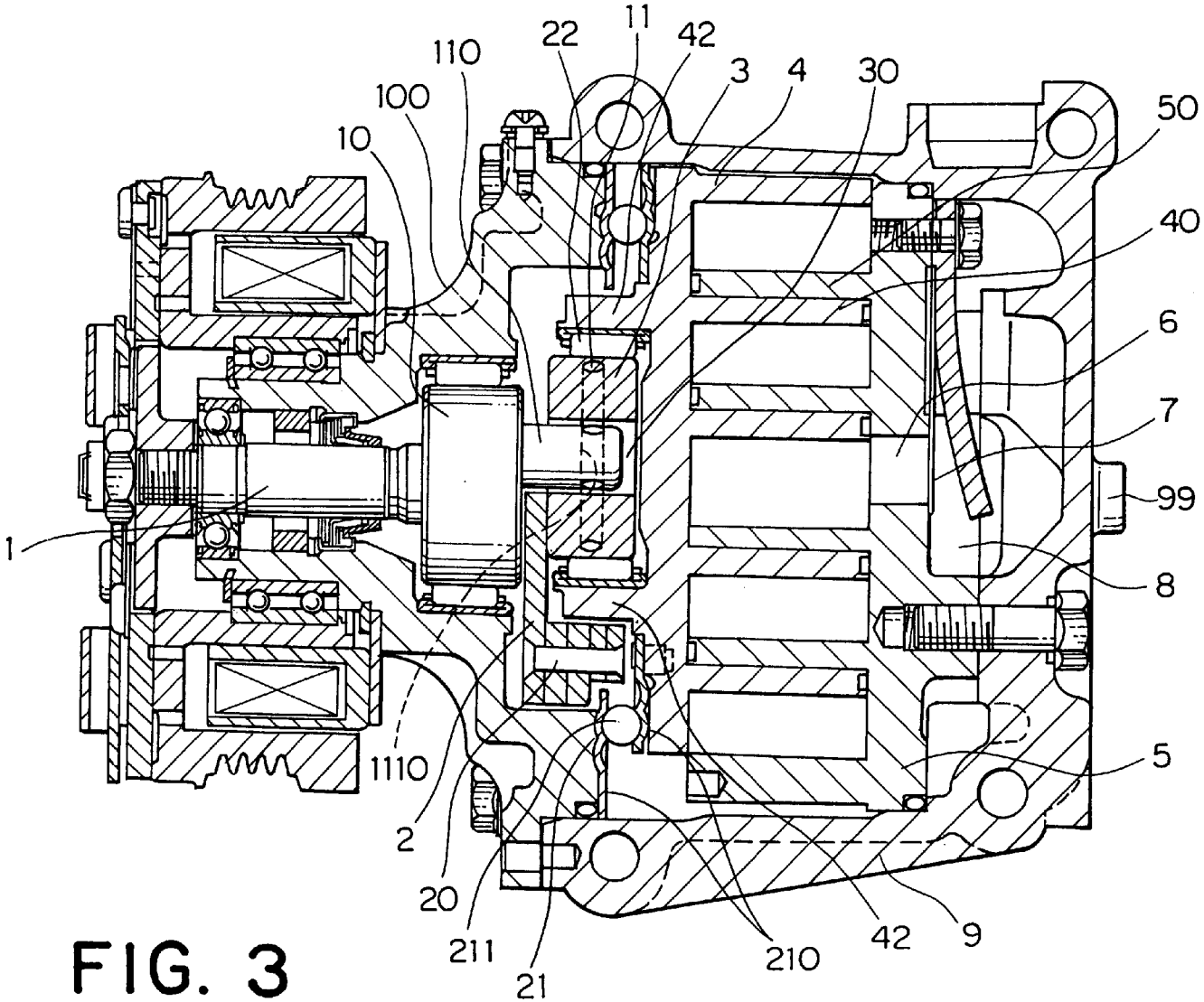
FIG. 3 is an explanatory diagram showing an entire structure of a scroll compressor employing an scroll structure according to the present invention.

Referring to FIG. 3, description will be made as regards a scroll compressor of a variable orbit-radius type known in the art. Similar parts are designated by like reference numerals.

In the scroll compressor, a rotation of the crank shaft 1 is rotated by a vehicle engine or the like to provide an orbiting motion of the crank pin 110 fixed to the large diameter portion 10 of the crank shaft 1.

The crank pin 110 is fitted to the bush hole 30 of the eccentric bush 3 the orbiting motion of the crank pin 110 provides directly an-orbiting motion of the eccentric bush 3. The eccentric bush 3 and the counter weight 2 are fixed to each other by inserting rivets 20 which are inserted through rivet holes of the two members 2 and 3 and caulked.

The counter weight 2 serves to provide a balance between the movable scroll member 4 and the eccentric bush 3 and also prevent generation of vibration of the compressor. The counter weight may be called also a balancing weight.

The movable scroll member 4 has an involute portion 40 on one side of a side plate 41, and an annular boss 42 on the other side thereof. The eccentric bush 3 is fitted and fixed in the annular boss 42 to permit a smooth rotation through the radial needle bearing 22.

By the structure described above, the eccentric bush 3 and the movable scroll member 4 fitted thereto are driven to make the orbiting motion. A rotation prevention mechanism 21 is provided for preventing a rotation of the movable scroll member 4. The rotation prevention mechanism 21 comprises a pair of annular laces 210 and a ball 211 therebetween. Accordingly, the movable scroll member 4 is subject to only the orbiting motion.

In FIG. 3, a rotational axis 99 of the crank shaft 1 is shown by a dashed line. The movable scroll member 4 moves in an orbital motion at the fulcrum of the axis 99. The radius of the orbital motion is smaller than the radius of the movable scroll member 4. In other words, the orbital way is located inside the movable scroll member 4 and. Therefore, it is seen that the movable scroll member 4 is moved in a swinging motion. Thus, the movable scroll member 4 is sometimes called a "swinging scroll" or "orbiting scroll".

The scroll compressor further comprises a fixed scroll member 5 having an involute portion 50. The movable scroll member 4 and the fixed scroll member 5 are located in an eccentric relation with each other with a predetermined distance being offset from each other. In addition, the two scroll members 4 and 5 are shifted at 180° from each other to form a plurality of sealed spaces therebetween in the manner known in the art. The sealed spaces have larger outer circumferences and smaller inner circumferences.

When the movable scroll member 4 moves in the orbital motion, a fluid is introduced from a suction port (not shown) and moved from the outer circumference to the inner circumference while it is compressed and then directed finally to a discharge port 6. A discharge chamber 8 has a high pressure and a lead valve 7 is normally closed. However, when the compressed fluid is discharged into to discharge port 6, the pressure in the discharge port 6 becomes higher and then opens the lead valve 7. Consequently, the compressed fluid is discharged from the discharge port 6 into the discharge chamber 8 through the lead valve 7.

Figure 4:
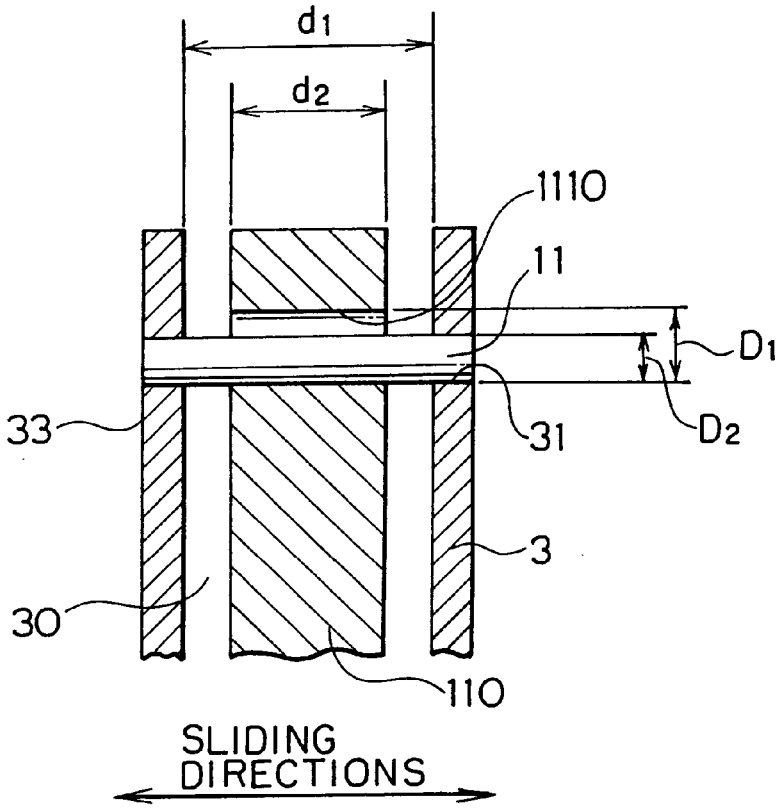
FIG. 4 is a diagram showing a relation among a crank pin, an eccentric bush, and pin in the scroll compressor of "type 1" according to the embodiment of the present invention.
Figure 5:
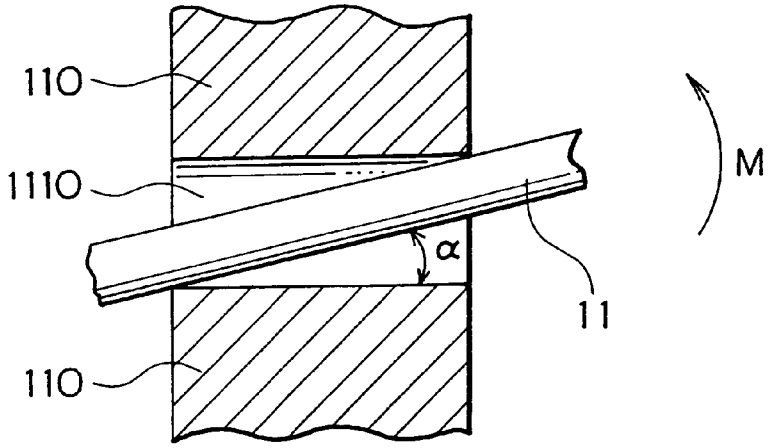
FIG. 5 is a diagram showing the condition between a pin hole of a crank pin and the pin when an inclination moment is given.

The operation described above is carried out in series by the scroll compressor when the fluid is compressed and it is to be understood that each of the parts and components described above is sealed and protected by a casing 9 and a front housing 100. Referring to FIGS. 4 and 5 together with FIG. 3, the description will be proceeded. The bush hole 30 has a size which permits the eccentric bush 3 to move in a radial direction of the crank pin 110. Namely, the bush hole 30 has a diameter greater than that of the crank pin 110. The crank pin 110 has a circular pin hole 1110 extending to penetrate the crank pin 110 in the radial direction. The eccentric bush 3 has a pair of through holes 31 which are opposite to each other through the bush hole 30 in the radial direction.

The scroll compressor further comprises a guide pin 11 has a circular cross section and is fixed to the eccentric bush 3 in the manner which will presently be described. The guide pin 11 has opposite end portions which are press-fitted in the through holes 31 of the eccentric bush 3, respectively. The guide pin 11 extends through the pin hole 1110 in the radial direction to guide movement of the eccentric bush 3 in the radial direction. The pin hole 1110 has a diameter D1 which is sli+ghtly greater than a diameter D2 of the guide pin 11 to enable inclination of the eccentric bush 3 within a predetermined inclination angle $\alpha$. The diameters D1 And D2 are set to satisfy the following formula:

$$D1>D2.$$

The crank pin hole 30 of the eccentric bush 3 and the crank pin 110 may have a tubular shape in this embodiment, although not limited thereto, in view of workability thereof. Supposing that an inner diameter of the eccentric bush 3 is represented by dl and that a diameter of the crank pin 110 is represented by d2, a movable distance (S) of the eccentric bush 3 is obtained by the following:

$$S=d1-d2.$$

Since the counter weight 2 is connected to the eccentric bush 3, a inclination moment generated by a centrifugal force applied to the counter weight 2 is delivered to the eccentric bush 3. At this event, the inclination of the counter weight 2 is prevented by the guide pin 11 and the pin hole 1110 of the crank pin 110. In other words, the guide pin 11 is controlled by an edge portion of the pin hole 1110 of the crank pin 110, as illustrated in FIG. 5. Although FIG. 5 is an exaggerated illustration, the predetermined inclination angle $\alpha$ can be made smaller by narrowing the pin hole 1110 (that is, by decreasing the value of D1) and thus the inclination of the counter weight 2 can be controlled It is preferable that the predetermined inclination angle $\alpha$ is set smaller than 2°.

In the case of high speed compressors and high pressure compressors, it will naturally be understood that the structure of only a single guide pin does not provide a stable state relative to a force which is perpendicular to the pin axis (that is, a perpendicular component of composite force of a centrifugal force, a compression reactive force, etc.).

In the case as described above, provision of two parallel guide pins will preferably solve the instability problem and a stable condition can be obtained, because while a single pin structure provides a rotation at the axis of the guide pin when a force perpendicular to the pin is added and, on the other hand, in the two-pin structure as described above the second pin will serve to prevent the rotation and control the inclination of the eccentric bush 3 and prevents the inclination of the counter weight 2.

The eccentric bush 3 is rotated with an outer diameter surface (outer circumference) thereof contacting the needle bearing 22, which is disposed between the movable scroll member 4 and the eccentric bush 3. In this case, there will be no problem if the through hole 31 of the eccentric bush 3 is located at the place where no load is added and. On the other hand, it is assumed as a particular case that the through hole 31 is located at the place where a load is added it is likely that the needle bearing 22 is damaged by the through hole 31 of the eccentric bush 3.

Figure 6:
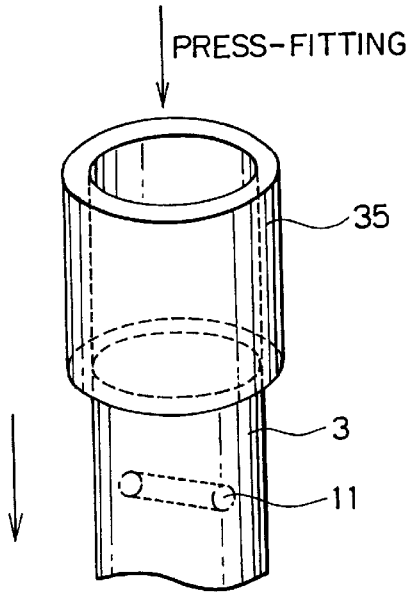
FIG. 6 is an explanatory view showing a method of mounting an outer circumferential ring to an eccentric bush in an embodiment of the invention.
Figure 7A:
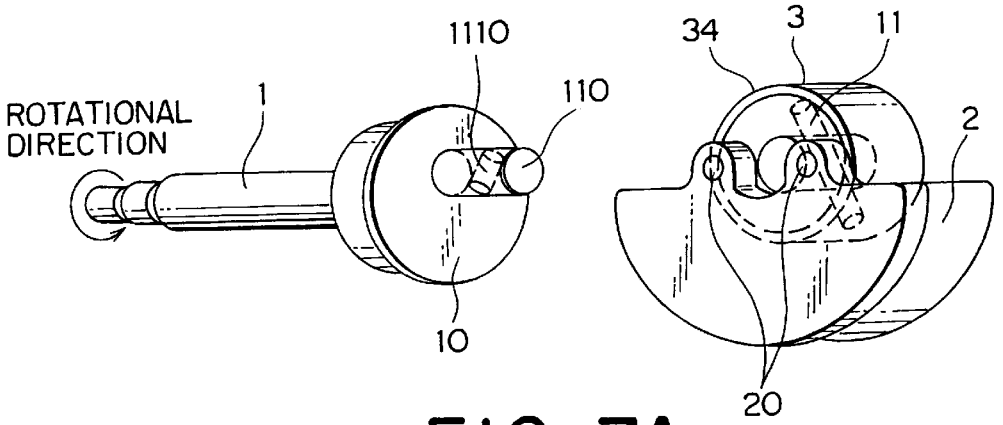
FIGS. 7A and 7B are an explanatory perspective view and a diagram, respectively, the former showing a method of assembly of crank shaft, an eccentric bush and counter weight in a scroll compressor according to another embodiment of the invention.
Figure 7B:
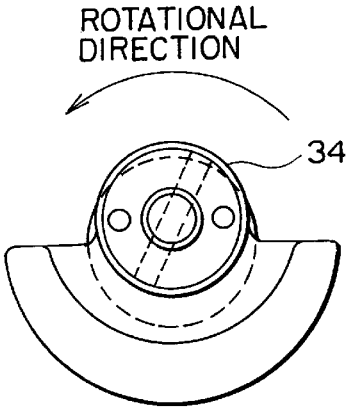

Referring to FIGS. 6, 7A, and 7B, the description will be made as regard the particular case. A ring member or a outer circumferential ring 35 of a tubular shape is press-fitted over an outer circumference of the eccentric bush 3 to thereby cover or close the through hole 31 of the eccentric bush 3. This can prevents a moving surface of the needle bearing 22 from contacting an end of the through hole 31 of the eccentric bush 3.

Especially, in the place where the rotational speed and/or conditions of load varies substantially, the end of the through hole 31, if it is exposed, will possibly increase damages to the needle bearing 22 and likely increase loads to the other portions and parts. These disadvantages can be prevented in advance by the outer circumferential ring 35. The outer circumferential ring 35 can be made of the material which is same as or similar to the bearing steel but the central portions can be made of less expensive material or with sintered parts. The circumferential ring 35 can be used for either the single guide pin structure or the two guide pin structure.

Next, the description will be made as regards the above-mentioned inclination moment. The inclination moment becomes maximum on a line between center axes of the crank shaft 1 and the crank pin 110. Accordingly, as far as prevention of the inclination of the counter weight 2 is concerned, it is preferable that the pin hole 1110 of the crank pin 110 be formed on the line described above.

However, the pin hole 1110 is determined at a specified or predetermined angle in an actual practice of the present invention, taking the contact condition between the scroll members into account.

Figure 8A:
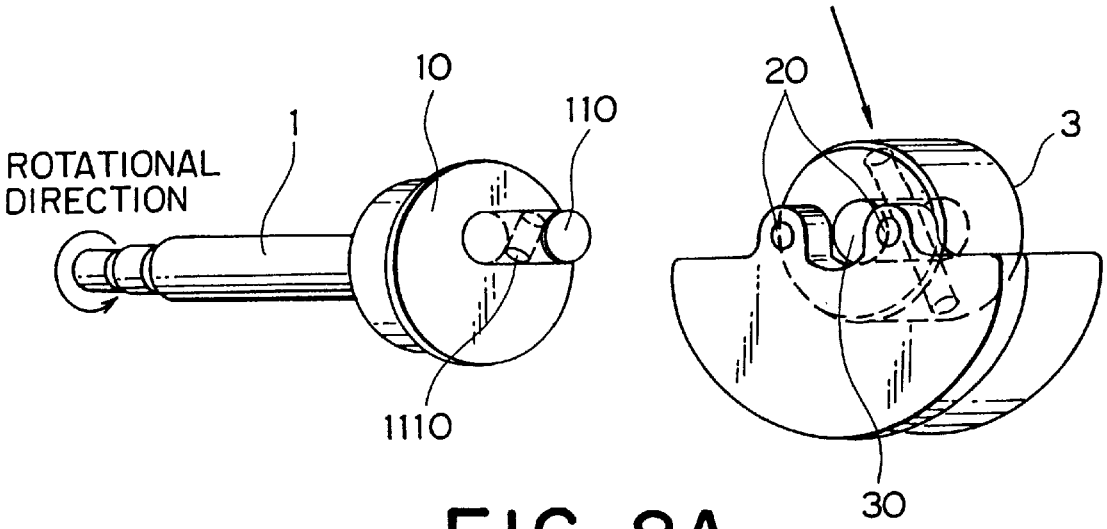
FIGS. 8A and 8B are an explanatory perspective view and a diagram, respectively, the former showing a method of assembly of crank shaft, an eccentric bush and counter weight in a scroll compressor of single guide pin structure according to the present invention and the latter showing the forming direction of the pin hole.
Figure 8B:
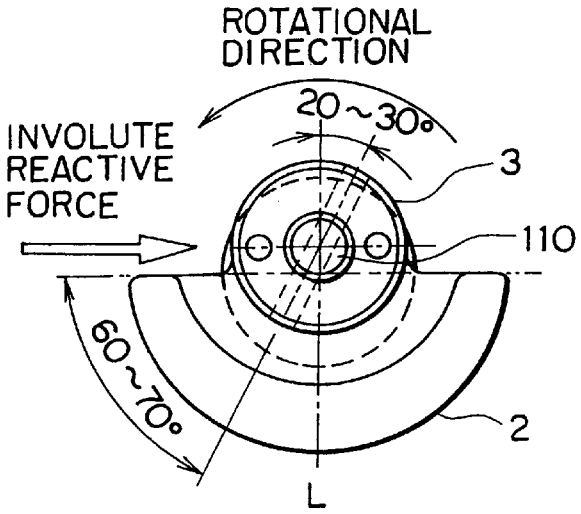

Referring to FIGS. 8A and 8B in addition to FIG. 3, the description will be directed to the single guide pin structure. The crank pin 110 is disposed in the position which is substantially equal to an orbiting radius of the movable scroll member 4. The crank pin 110 is circular merely for the purpose of simplification of the drawing. Any other shapes can be selected as desired for the crank pin 110. The crank pin 110 may be formed so that it has a forged, untreated surface and, similarly. The eccentric bush 3 may have a forged, untreated surface.

In FIG. 8B, a dotted line L is a straight line which connects between a center of the crank shaft 1 and a center of the crank pin 110, and the pin hole 1110 is set to be located at about 20–30° relative to the straight line L. In other words, the pin hole 1110 extends to have a predetermined angle relative to a reference plane including centers of the crank shaft 1 and the crank pin 110. Provision of this angle has reasons which will be explained below.

Since the direction of the scroll compression reactive force is offset or shifted at about 60–70° relative to the axial line of the pin 11, the movable scroll member 4 is moved toward the position where its orbital radius becomes larger and a favorable contact condition between the involute portions 40 and 50 can be maintained.

Theoretically, the inclination moment due to the centrifugal force becomes maximum on the straight line L where its amount of variation (displacement) becomes maximum but, on the other hand, since an amount of the inclination of the counter weight 2 which is caused by the inclination moment is extremely small within the angular range of 20–30° relative to the straight line L, there will be no problem.

Further, the eccentric bush 3 is rotated in the direction of the scroll compression reactive force at the axis (fulcrum) of the guide pin 11 and a desirable contact condition is maintained relative to the needle bearing 22 for driving the movable scroll member 4. For the reasons described above, the pin hole 1110 is decided by proving an angular degree of 20–30° relative to the straight line L or the reference plane.

With the single guide pin structure, the eccentric bush 3 and the single guide pin 11 are formed into a unitary structure and the guide pin 11 is loosely fitted through the pin hole 1110 of he crank pin 110, so that the eccentric bush 3 can be rotated freely with respect to the axis of the guide pin 11. Thus, a desirable contact can be maintained relative to the needle bearing 22.

Referring to FIGS. 9A and 9B in addition to FIG. 3, the description will be directed to the tow guide pin structure. The crank pin 110 has a plurality or two circular pin holes 1110 each extending to penetrate the crank pin 110 in the radial direction. The eccentric bush 3 has plural pairs of through holes 31. The through holes 31 of each of the pairs being opposite to each other through the bush hole 30 in the radial direction. The scroll compressor further comprises a plurality or two guide pins 11 each of which has a circular cross section and is fixed to the eccentric bush 3 in the manner which is similar to the single guide pin structure. Each of the guide pin 11 extends through the pin hole 1110 in the radial direction to guide movement of the eccentric bush 3 in the radial direction.

With respect to the through holes 31 and the pin holes 1110, supposing that the diameter of each of the pin hole 1110 is represented by D1, the diameter of each of the through holes 31 is represented by D2, the distance between centers of the pin holes 1110 is represented by A1, the distance between centers of the through holes 31 is represented by A2, the maximum distance of outer diameter of the pin holes 1110 is represented by B1, and that the maximum distance of outer diameter of the through holes B2, these holes 31 and 1110 are determined to satisfy the following:

$$A1<A2$$

$$B1>B2$$

$$A1+D1=B1$$

$$A2+D2=B2.$$

It is a matter of course that the pin holes 1110 are formed such that the direction of the pin holes 1110 are perpendicular to the crank pin axis and the crank pin hole of the eccentric bush 3 and that each of the pin holes 1110 are in a parallel relation. In other words, when the crank pin 110 and the eccentric bush 3 are assembled under the conditions described above, the eccentric bush 3 and the guide pin 11 are, as shown in FIG. 9C, moved in a unitary structure along the pin hole 1110 of the crank pin 110. This is similar as the single guide pin structure described previously. The features of the two guide pin structure are different from the single guide pin structure as will be described below.

As illustrated by FIGS. 9D and 9E, when the inclination moment is effected to rotate the eccentric bush 3 (and also the unitarily attached counter weight 2) at the center of the axis of the guide pins 11, each of the pin holes 1110 are then interfered with each other to obstruct the inclination of the counter weight 2.

Thus, this structure permits a movement of the movable scroll member 4 along with the variance of the orbiting radius thereof, and a stable state and posture of the eccentric bush 3 can be maintained without any influence by changes in a rotational speed and loads.

It will possible that controlling of the pin hole diameter, such as decreasing the diameter of the pin hole 1110 of the crank pin 110, or modification of the distance between the pin holes 1110 will lessen the predetermined inclination angle $\alpha$. However, in the illustrated embodiment a diameter of the pin hole 1110 of the crank pin 110 is made large enough to some extent and the distance between the pin holes 1110 is made smaller than the distance between the through holes 31 of the eccentric bush 3 so that an inclination angle to a certain extent can be obtained, for the reasons that the eccentric bush 3 can rotate slightly around the axis which is parallel to the guide pin 11 in such a manner that it can contact accurately to the bearing of the movable scroll member 4.

With the tow guide pin structure, a stable posture of the eccentric bush 3 can be obtained because the two guide pin structure is not influenced or badly effected by changes of rotational speed and load. Further, the contact condition relative to the needle bearing 22 can be adjusted by diameters of each of the crank pins 11 and each of the through holes 31 of the eccentric bush 3 as well as the positional relations thereof and, therefore, no problem will be raised with respect to the contact relative to the needle bearing 22.

While the present invention has thus far been described in connection with a few embodiments thereof, it will readily be possible for those skilled in the art to put this invention into practice in various other manners. For example, it is appreciated that the present invention is applicable to vacuum pumps and expansion devices as well

What is claimed is:

1. A scroll compressor comprising:

a fixed scroll member;

a movable scroll member eccentrically spaced from the fixed scroll member;

an eccentric bush rotatably held to said movable scroll member and having a bush hole therein; and a crank shaft having a crank pin inserted in said bush hole;

said bush hole having a size which permits said eccentric bush to move in a radial direction of said crank pin, said crank pin having a pin hole extending to penetrate said crank pin in said radial direction, said scroll compressor further comprising a guide pin fixed to said eccentric bush and extending through said pin hole in said radial direction to guide movement of said eccentric bush in said radial direction.

2. A scroll compressor as claimed in claim 1, wherein said bush hole has a diameter greater than a diameter of said crank pin.

3. A scroll compressor as claimed in claim 1, wherein said eccentric bush has a pair of through holes which are opposite to each other through said bush hole in said radial direction, said guide pin having opposite end portions which are press-fitted in said through holes, respectively.

4. A scroll compressor as claimed in claim 3, further comprising an ring member which is press-fitted over said eccentric bush to cover said opposite end portions of said guide pin.

5. A scroll compressor as claimed in claim 4, further comprising a radial bearing fixed to said movable scroll member and fitted over said ring member for rotatably holding said ring member.

6. A scroll compressor as claimed in claim 1, wherein said pin hole having a diameter which is slightly greater than a diameter of said guide pin to enable inclination of said eccentric bush within a predetermined inclination angle.

7. A scroll compressor as claimed in claim 6, further comprising a counter weight connected to said eccentric bush for providing a balance between said movable scroll member and said eccentric bush.

8. A scroll compressor as claimed in claim 1, wherein said pin hole extends to have a predetermined angle relative to a reference plane including centers of said crank shaft and said crank pin.

9. A scroll compressor comprising:

a fixed scroll member;

a movable scroll member eccentrically spaced from the fixed scroll member;

an eccentric bush rotatably held to said movable scroll member and having a bush hole therein; and a driving shaft having a crank pin inserted in said bush hole, said bush hole having a size which permits said eccentric bush to move in a radial direction of said crank pin, said crank pin having a plurality of pin holes each extending to penetrate said crank pin in said radial direction, said scroll compressor further comprising a plurality of guide pins fixed to said eccentric bush and extending parallel to each other through said pin holes in said radial direction, respectively, to guide movement of said eccentric bush in said redial direction.

10. A scroll compressor as claimed in claim 9, wherein said bush hole has a diameter greater than a diameter of said crank pin.

11. A scroll compressor as claimed in claim 9, wherein said eccentric bush has plural pairs of through holes, said through holes of each of the pairs being opposite to each other through said bush hole in said radial direction, each of said guide pins having opposite end portions which are press-fitted in said through holes of each of the pairs, respectively.

12. A scroll compressor as claimed in claim 11, further comprising an ring member which is press-fitted over said eccentric bush to cover said opposite end portions of said guide pins.

13. A scroll compressor as claimed in claim 12, further comprising a radial bearing fixed to said movable scroll member and fitted over said ring member for rotatably holding said ring member.

14. A scroll compressor as claimed in claim 9, further comprising a counter weight connected to said eccentric bush for providing a balance between said movable scroll member and said eccentric bush.

15. A scroll compressor as claimed in claim 9, wherein each of said pin holes extends to hare a predetermined angle relative to a reference plane including centers of said crank shaft and said crank pin.

* * * * *